US005186247A

United States Patent [19]

Schlemenat

[11] Patent Number: 5,186,247

[45] Date of Patent: Feb. 16, 1993

[54] HIGH TEMPERATURE/PRESSURE GAS TUBULAR HEAT EXCHANGER

[75] Inventor: Alfred Schlemenat, Herten, Fed. Rep. of Germany

[73] Assignee: Man Gutehoffnungshutte AG, Oberhausen, Fed. Rep. of Germany

[21] Appl. No.: 870,333

[22] Filed: May 4, 1992

[30] Foreign Application Priority Data

May 10, 1991 [DE] Fed. Rep. of Germany ..... 4115250

[51] Int. Cl.[5] ..... F28D 7/14; F28F 9/22

[52] U.S. Cl. ..... 165/162; 165/163; 165/906

[58] Field of Search ..... 165/158, 159, 161, 162, 165/163, 81, 906

[56] References Cited

U.S. PATENT DOCUMENTS

| | | | |
|---|---|---|---|
| 3,134,432 | 5/1964 | Means | 165/162 |
| 3,228,463 | 1/1966 | Kagi | 165/158 |
| 3,316,961 | 5/1967 | Dorner | 165/158 |
| 3,626,481 | 12/1971 | Taylor et al. | 165/162 |
| 4,084,546 | 4/1978 | Schneeberger et al. | 165/163 |
| 4,271,900 | 6/1981 | Reitz | 165/163 |
| 4,786,463 | 11/1988 | Fernandez et al. | 165/163 |
| 4,852,644 | 8/1989 | Schlemenat et al. | 165/163 |

FOREIGN PATENT DOCUMENTS

| | | | |
|---|---|---|---|
| 297696 | 12/1987 | Japan | 165/162 |
| 143817 | 4/1961 | U.S.S.R. | 165/158 |
| 484379 | 12/1975 | U.S.S.R. | 165/163 |
| 1372172 | 2/1988 | U.S.S.R. | 165/163 |

*Primary Examiner*—John Rivell
*Assistant Examiner*—L. R. Leo
*Attorney, Agent, or Firm*—McGlew and Tuttle

[57] ABSTRACT

The present invention pertains to a tubular heat exchanger for operation at high gas temperature and high pressures with heat exchanger tubes, which are coiled on the greater section of their linear extension. Further, the tube bottoms have tie rods, which brace the tube bottoms. The tie rods (3) of a graduated circle (1*a*, 1*b*) are connected at several points in the longitudinal direction by rings (5) into a cage. The tie rods (3) are flattened (3*a*) in the area of the rings (5). The tubes arranged on the adjacent graduated circle are connected to one another in the coiled area (2*a*) by means of angular plates (4) in pairs in the area of the rings (5). The connection to the angular plates (4) is such that, the tube form a hollow-cylinder-shaped tube cage. At least three guiding plates (6, 6*a*) are arranged in each area of uncoiled tubes (2*b*).

5 Claims, 6 Drawing Sheets

HIGH TEMPERATURE/PRESSURE GAS TUBULAR HEAT EXCHANGER

FIELD OF THE INVENTION

The present invention pertains to a tubular gas heat exchanger for operation at high gas temperatures and high gas pressures with a thin tube bottom each on the gas inlet side and the gas outlet side, with heat exchanger tubes arranged on graduated circles of the tube bottoms, which heat exchanger tubes are coiled on the largest section of their linear extension, and with tie rods (anchors), bracing the bottoms, arranged on every other graduated circle.

BACKGROUND OF THE INVENTION

Tubular heat exchangers with coiled tubes in combination with tie rods bracing the tube bottoms have been developed according to DE 36,40,970 C2 for the operation of high pressurizations on the casing under extremely high thermal loads acting at the same time.

In this heat exchanger structure, two thin-walled tube bottoms are connected via tension rods, which rods are arranged on concentric graduated circles.

The radial distance of the graduated circles is selected such that sufficient room for the heat exchanger tubes remains on the intermediary ring areas. These heat exchanger tubes are coiled on the greatest section of their length over the longitudinal axis of the container.

Due to the necessary elasticity of the coil with at least one winding, the external row of tubes determines the cylindrical length of the coiled area of all rows of tubes. Since the exchange surfaces of all tubes and thus the extended tube lengths should be as equal as possible, the coiled tubing on the graduated circles towards the center of the tube bottom has a number of windings greater than 1 with constant angle of inclination. The ends of the tubes are not coiled and run parallel to the longitudinal axis of the heat exchanger. The direction of rotation of the coiling changes from graduated circle to graduated circle.

The tie rods, around which coolant flows, are acted upon with the same temperature as the casing and are thus also subjected to the same heat expansions.

As a result of the flexibility of the coil, the tubes acted upon with higher temperatures only release small forces, created as a result of the heat expansion, as a load on the tube bottoms. Thus, by means of the combination of the bracings tie rods with the coiled tubes, high pressures can be absorbed by the casing and the highest temperatures can be absorbed by the tubes without damage.

Due to the narrow tube separations, there is no possibility in the area of the coiling of connecting the bundles of tubes of the individual graduated circles to one another, in order to bring about a necessary support among them or on the cylinder wall of the heat exchanger.

However, in a horizontal installation of the heat exchanger, since the weight of the bundles of tubes must be diminished, and even in a vertical installation, supports of the tubes are necessary to avoid vibrations, the tie rods arranged on the adjacent graduated circles lying towards the outside should also be referred to as holding elements and even as supporting elements of a bundle of tubes.

SUMMARY AND OBJECTS OF THE INVENTION

It is an object of the present invention to produce a device which supports the weight of the bundles of tubes themselves especially in the horizontal installation of the heat exchanger, prevents deflections of the tubes and thus avoids an overheating of the coiled tubes by the resting of tie rods on the coiled tubes of the next graduated circle. The vibrations also occurring in the vertical installation due to the support of the coiled tubes should be reduced.

According to the invention, a tubular heat exchanger is provided for operation at high gas temperatures and high pressures. A thin tube bottom or end is provided in each of a gas inlet side and a gas outlet side. The heat exchanger tubes are arranged on graduated circles of the tube bottoms and the heat exchanger tubes are coiled for a greater sectional part of their linear extension. Tie rods are provided for bracing bottoms of the tubes and these tie rods are arranged on every other graduated circle. The tie rods of every other graduated circle are connected to one another at several points in the coiled area or section of the tubes in the longitudinal direction of the heat exchanger by rings to form a cage. The tie rods are flattened in an area of the ring connections and maintain a full cross sectional area in the other regions. The tubes arranged on one of the individual graduated circles (of the two bottoms or ends), in the coiled area or section, are connected to one another by means of angular plates to form connected pairs of adjacent tubes in the area of the rings, arranged in the longitudinal direction of the heat exchanger.

Preferably at least three guiding plates are arranged in each area or section wherein the tubes are not coiled (uncoiled tube section). The guide plates include outer guide plates with recesses for the tie rods providing contact seats. Angular gaps are provided for the uncoiled tubes when the angular gaps have boring tolerances. The inner guiding plates preferably extend over the entire cross section of the heat exchanger casing. These inner guiding plates include recesses for the tie rod to provide contact seats and angular gaps are provided for the uncoiled tubes which angular gaps are designed large such that a change in the direction of flow is adjusted according to the guiding plate.

The diminishing of the weight of the bundle of tubes depends on the type of installation of the heat exchanger. The weight of the bundle of tubes is absorbed by the so-called "cold" tube bottom in the vertical type of installation. Due to the load content from the weight of the bundle of tubes, the tie rods and the rings, this "cold" tube bottom is designed more thick-walled than the "hot" tube bottom, which should not be involved in the load bearing performance, since said "hot" tube bottom must be designed as extremely thin due to its adequate cooling ability. In this type of installation, the cage, which consists of tie rods and rings, is made to support the bundles of tubes against vibrations.

In the construction according to the present invention, namely, a cage of tie rods produced by means of rings, since the tie rods have an effective column length and absorb high pressure loads, the heat exchanger can overcome high pressures both on the part of the tubes and on the part of the casing.

In the horizontal type of installation, the "hot" tube bottom can likewise not be made to absorb greater additional loads. The angular plates welded onto the tubes transfer the weight of the bundles of tubes via the rings onto the tie rods which open into the tube bottoms. In order not to introduce the individual weights of these components into the tube bottoms, the guiding plates arranged in the area of the uncoiled tube ends towards the tube bottoms, which should guarantee the uniform, all-over cooling, above all, of the hot tube bottom, are also used to relieve the tube bottoms. The individual weights are introduced directly into the heat exchange casing via the guiding plates.

In order to obtain basic statements about orders of magnitude of arising deflections of the support system of the cage of tie rods according to the present invention, as well as statements about forces, which are released by the individual tie rods onto the tube bottoms, onto the rings and onto the guiding plates, three-dimensional investigations were carried out by means of stress analyses, which investigations confirm that, even in the horizontally installed heat exchanger with extremely great overall length, relatively small deflections of the cage of tie rods occur, such that an overheating of the tubes does not occur due to the resting of tie rods on the tubes of the next graduated circle. Furthermore, it was confirmed that the individual weights of the tube coils and the cages of tie rods were directly introduced into the heat exchanger casing via the guiding plates. The additional loads released by the tie rods onto the tube bottoms from the load bearing performance of the cages of tie rods are small.

Special advantages of the construction of the tubular support according to the present invention lie in the fact that expansion movements of the tubes, all appearing as a result of temperature load, occur completely contact-free. Tube guiding and weight diminishing problems, as they appear in tubular heat exchangers of the state of the art, i.e., contracting of tubes in the area of guiding plates and braces due to accelerated growth of C-steel corrosion products in the annular gap between tubes and mounting, caused by the increase in concentration of contaminants present in the coolant (so-called denting), do not appear here. Likewise, there is also no weakening of the tubes due to the appearance of corrosion due to friction or fretting (so-called fretting).

It is a further object of the invention to provide a high gas temperature high gas pressure tubular heat exchanger which simplifies design, is rugged in construction and is economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
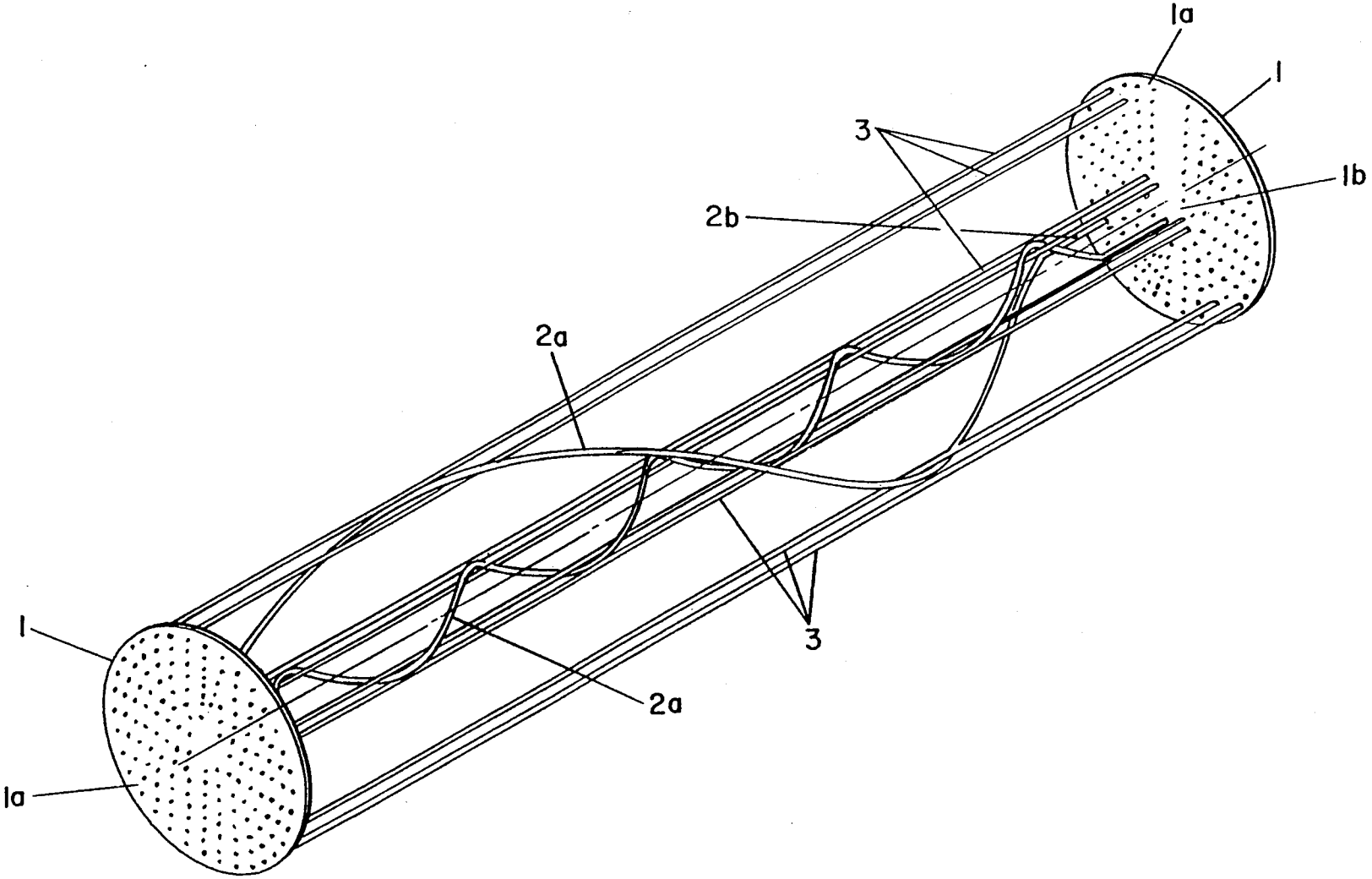
FIG. 1 is a schematic perspective view showing the basic principle of the tubular heat exchanger according to the invention.

Referring to the drawings in particular, FIG. 1 shows the basic principle of the tubular heat exchanger according to the present invention in a perspective view, in which only one coiled tube 2*a* is detailed on the outer graduated circle 1*a* and only one coiled tube is detailed on the inner graduated circle 1*b*, respectively. Several tie rods 3, bracing the tube bottoms, are shown on the adjacent graduated circles of the coiled tubes 2*a* shown.

The tie rods 3 lying on a graduated circle are detailed as holding or support elements for the coiled tubes 2*a* arranged on the adjacent graduated circle lying towards the inside. The tie rods 3 themselves support the tube bottoms or ends 1 against the inner pressure present within the heat exchanger casing 7. As a result of this, the tie rods are stressed by longitudinal forces.

Figure 2B:
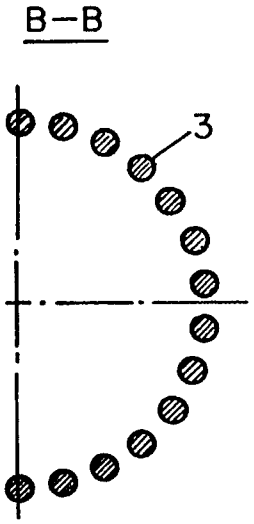
FIG. 2*b* is a cross-sectional view taken along line B—B of FIG. 2 showing the tie rods having a circular cross-section.
Figure 2:
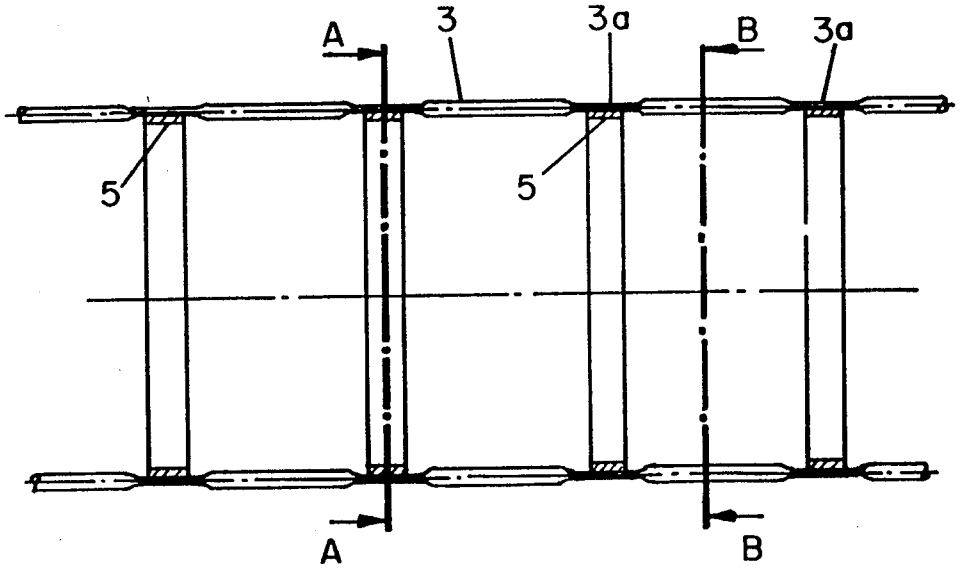
FIG. 2 is a cut-away view showing the tie rods and rings connected to one another to form a cage.
Figure 2A:
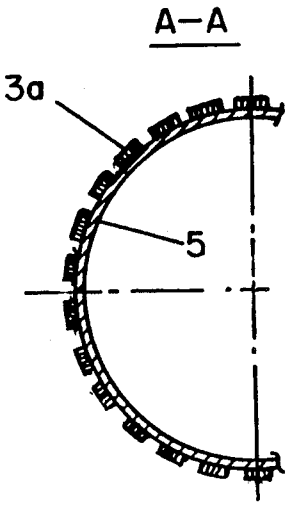
FIG. 2*a* is a cross-sectional view taken along line A—A of FIG. 2 showing the tie rods having a flattened cross-section and a connected ring.

Corresponding to FIG. 2, the tie rods 3 of a graduated circle are connected to one another at several points by rings 5 into a cage in the longitudinal direction of the heat exchanger. The amounts of the distances of the rings 5 determine the load bearing performance of the cages of tie rods.

Figure 3:
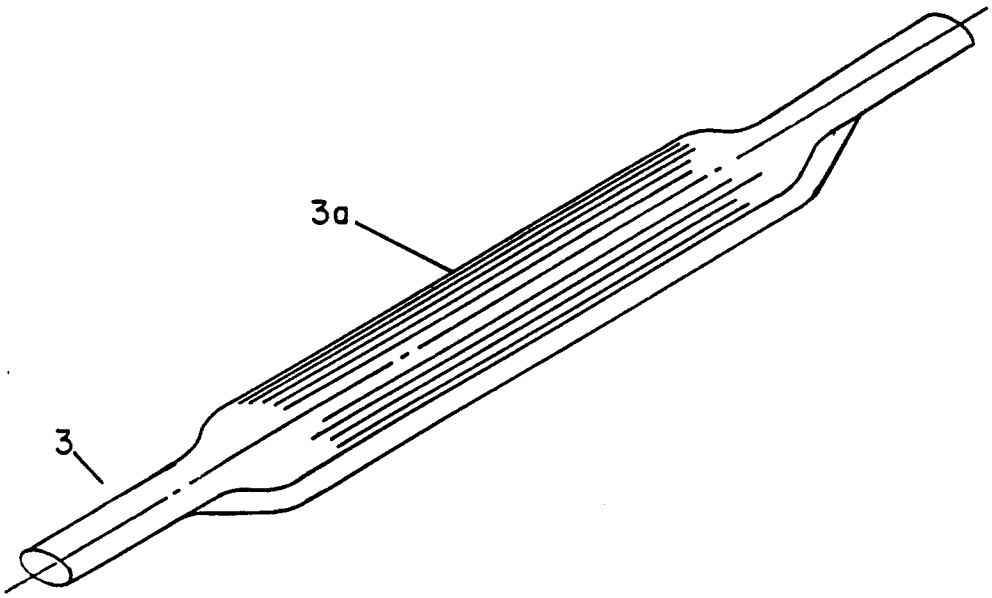
FIG. 3 is a schematic perspective view showing the tie rods having a round and flattened cross section.

The tie rods 3 with round cross section are flattened 3*a* in the area of the ring connections as shown in FIG. 3.

The change in cross section and tangential arrangement of the flattened tie rods 3*a* are also evident in FIG. 2. By means of this connection, two results are achieved. No additional load of the tie rods 3 appears, due to an offset in the stress direction and the rotational symmetry of the rings 5, favorable for loads, need not be changed.

In flattened tie rod cross sections 3*a* on the attachment positions of the rings 5, the intended space savings in each graduated circle area lead to a reduction in the outer diameter of the heat exchanger 7. The surfaces of the tie rods 3 and of the rings 5, almost running in parallel, represent an optimal condition for the welding of the connection seams.

Figure 4:
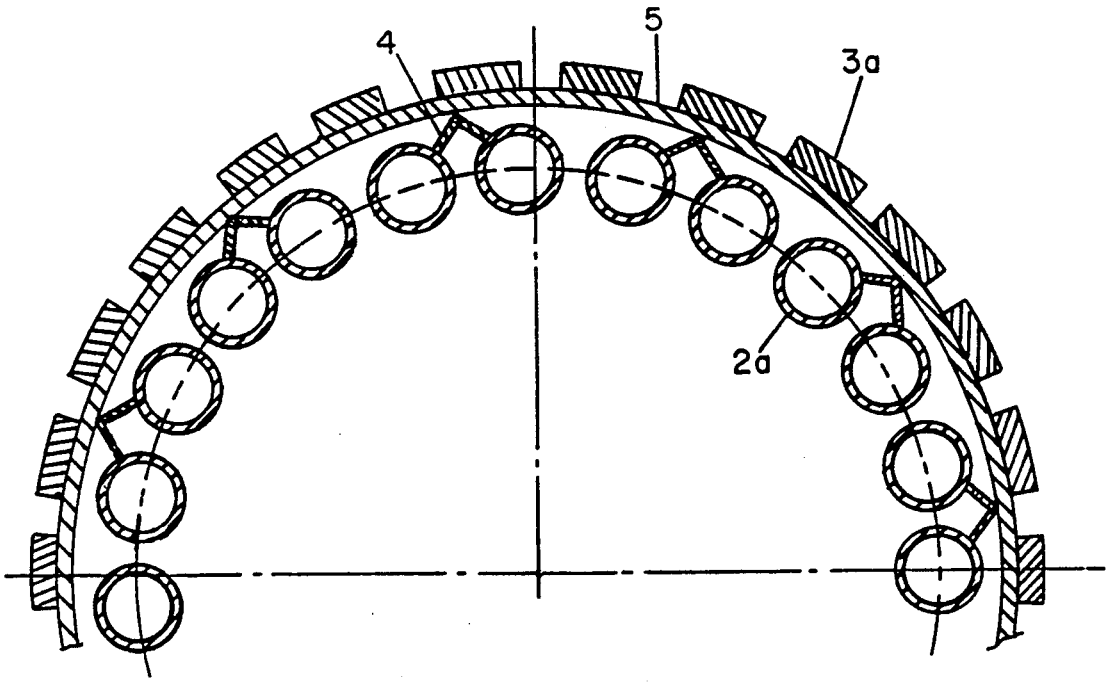
FIG. 4 is a cross sectional view taken along line A—A from FIG. 2 also showing the heat exchanger tubes attached in pairs to angular plates.

The coiled tubes 2*a* arranged on a graduated circle are connected to one another by means of angular plates 4 according to FIG. 4, in pairs in the area of the rings 5 arranged in the longitudinal direction of the heat exchanger. By means of the connection with the angular plates 4, the tubes 2*a* represent a hollow-cylinder-shaped cage of tubes. In the area of the supporting rings 5, only two tubes 2*a* lying next to one another (adjacent tube pair) are directly connected to one another. The connection to the next adjacent tube pair is made in the area of the next ring 5 (tubes not connected at the previous ring 5) along the longitudinal axis of the heat exchanger.

The arrangements of connections, changing in the area of a support (supporting rings 5) from one pair of tubes 2*a* to another pair of tubes 2*a* make possible, in the respective area of supports, tangential shifts of the angular plates of the pairs of tubes not connected to one another, while the necessary radial expansions can appear in the areas between the supports on all tubes.

Figure 5:
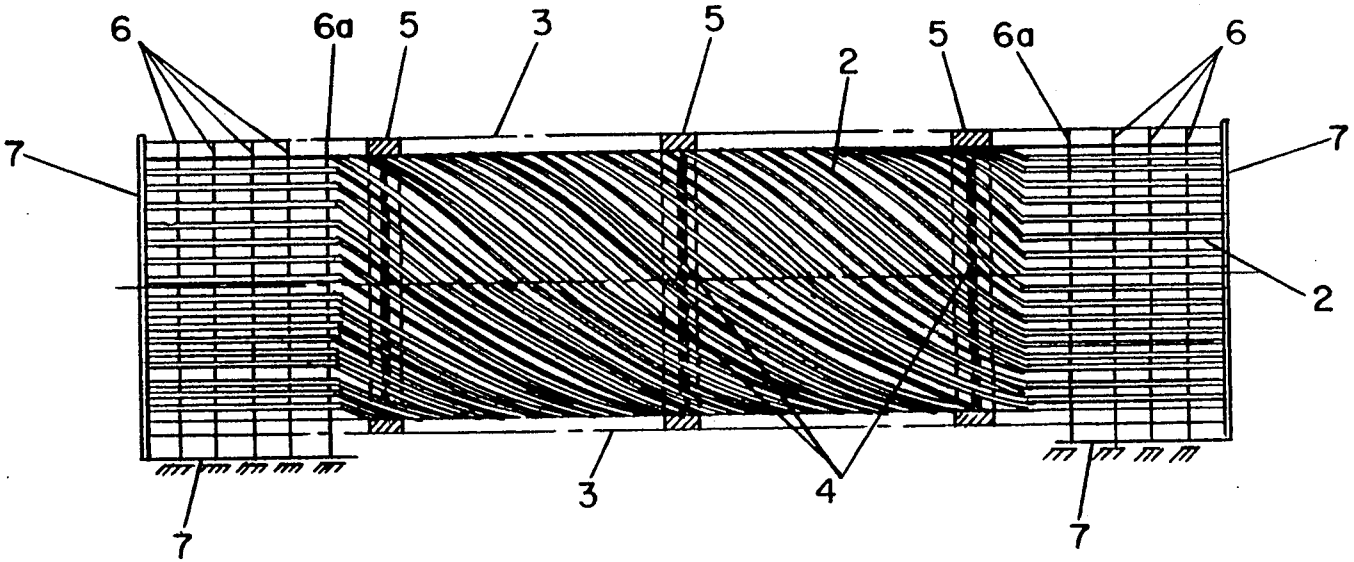
FIG. 5 is a schematic view showing the individual weight diminishing of tubes of a graduated circle via rings, tie rods and guiding plates onto the heat exchanger casing in a longitudinal section of the tubular heat.

In FIG. 5 there is shown the principle of weight diminishing of the coiled tubes 2*a* of the outer row via angular plates 4 onto the rings 5 as well as via the tie rods 3 and the guiding plates 6 into the heat exchanger casing 7.

In the areas of the tubular heat exchanger, in which the heat exchanger tubes run in a straight line, i.e., in the vicinity of both tube bottoms 1, guiding plates 6, 6*a* are arranged. Such guiding plates are basically known in tubular heat exchangers with heat exchanger tubes exclusively running in a straight line, as well as in heat exchangers with bundles of U-tubes.

Figure 6:
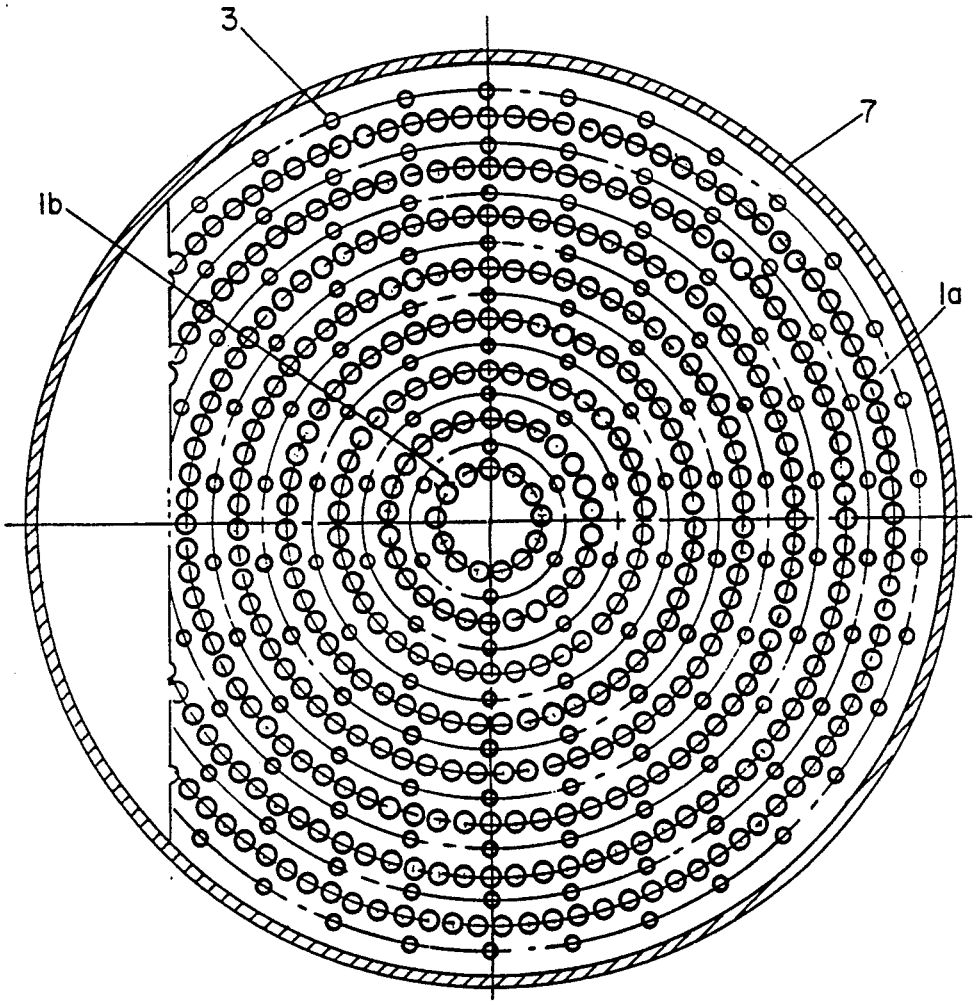
FIG. 6 is a top plan view of a guiding plate, arranged in the area of the tubes running in a straight line (the tubes themselves are not shown)

So-called outer guiding plates 6 are arranged in a baffle type manner at a right angle to the longitudinal direction of the heat exchanger at certain intervals (FIG. 6). The outer guiding plates fill out a section (e.g. a passage section as shown at the left of FIG. 6 is provided) of the entire heat exchanger casing cross section and are, as a result, arranged displaced such that the coolant is deviated from guiding plate to guiding plate and thus causes a crossflow of the tubes.

In the transition area on both sides between straight-line tubes 2*b* and coiled tubes 2*a* there is arranged a so-called inner guiding plate 6*a* which fills out the entire heat exchanger casing cross section.

The outer 6 and the inner 6*a* guiding plates are only attached to the external tie rods 3, and therefore, only lie on the heat exchanger 7 and the remaining tie rods 3 without attachment.

Figure 6A:
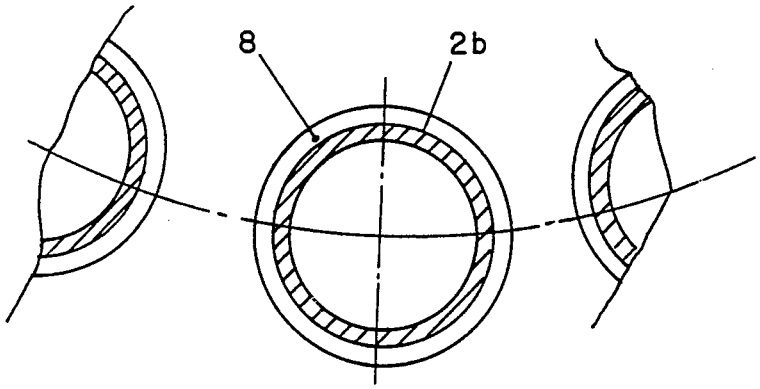
FIG. 6*a* is a detailed view according to FIG. 6 on an enlarged scale.

The outer guiding plates 6 have recesses for the tie rods 3 and the heat exchanger tubes 2*b*. The recesses in the guiding plates 6, 6*a* for the tie rods 3 are designed of such a magnitude that the tie rods have contact seats therein. The recesses or annular gaps 8, (according to FIG. 6*a* ) in the outer guiding plates 6, through which the heat exchanger tubes 2*b* extend, have boring tolerances, such that a contact of the tubes is avoided.

Figure 7:
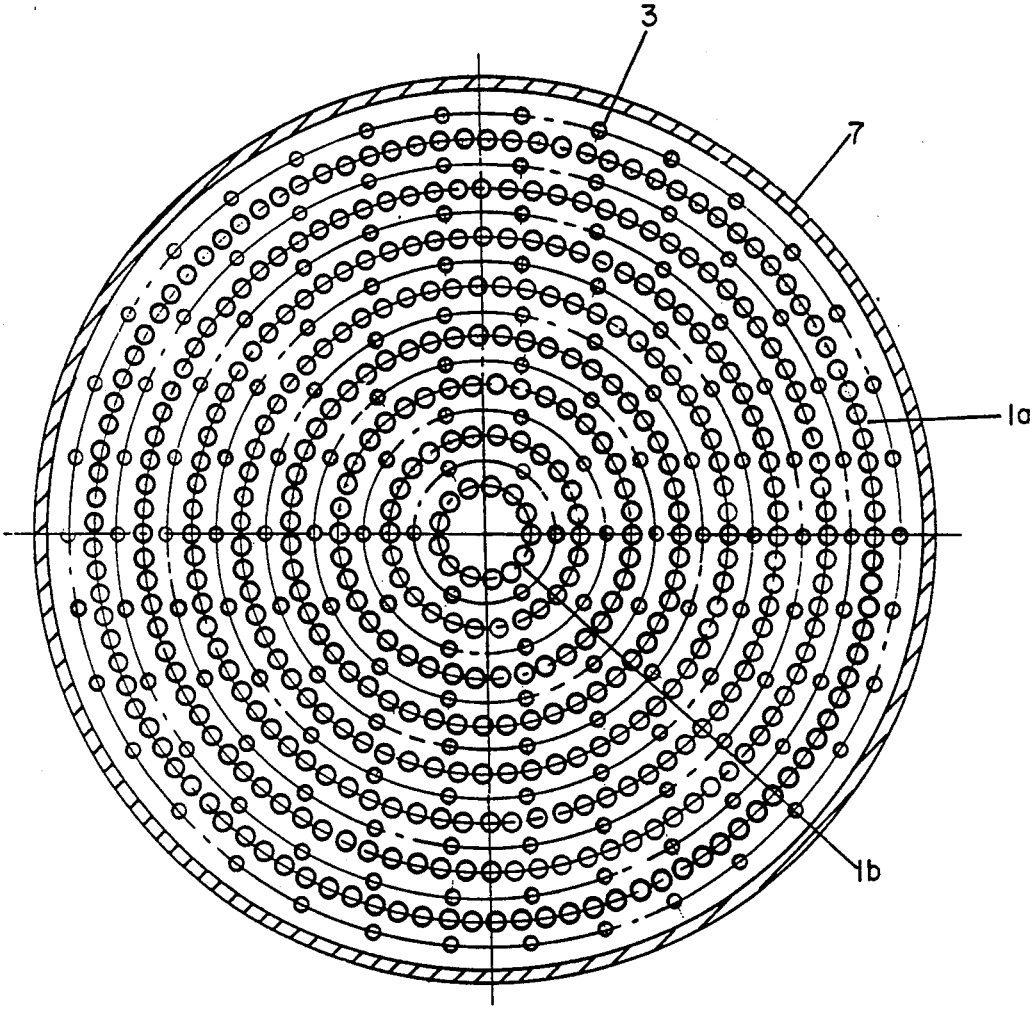
FIG. 7 is a top plan view of a guiding plate filling out the entire heat exchanger casing cross section in the area of the straight-line tubes.
Figure 7A:
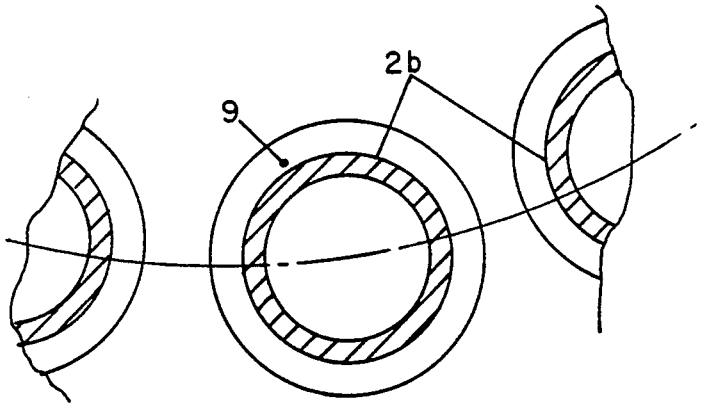
FIG. 7*a* is a detailed view according FIG. 7 on an enlarged scale.

While the recesses for the tie rods 3 in the inner guiding plates 6*a*, FIG. 7 are also conceived for contact seats, the annular gaps 9, (according to FIG. 7*a*), i.e., the annular space around the tubes, as is evident from FIG. 7, are made large such that the coolant, which was previously diverted by the outer guiding plates 6 to a crossflow, can flow in the longitudinal direction of the heat exchanger.

What is claimed is:

1. A tubular heat exchanger for operation at high gas temperatures and high gas pressures, comprising: a first end tube bottom at a gas inlet side and a second end tube bottom at a gas outlet side; each tube bottom having openings, the openings cooperating to form graduated circles; heat exchanger tubes arranged on said graduated circles, said heat exchanger tubes having a coiled section forming a greater part of a linear extension of said heat exchanger tubes; a plurality of tie rods arranged corresponding to every other graduated circle of the tube bottoms, said tie rods being connected between said tube bottoms in a coiled area of said tubes by rings to form a cage, said tie rods having a substantially circular cross-sectional area except in an area of each of said rings wherein said tie rods are flattened, each of said tubes being connected to one adjacent of said tubes to form connected pairs in said coiled area by angular plates positioned in said area of said rings.

2. A tubular heat exchanger according to claim 1, wherein at least three guiding plates are arranged in an area of said heat exchanger tubes wherein said heat exchanger tubes are uncoiled.

3. A tubular heat exchanger according to claim 2, wherein said at least three guiding plates include outer guiding plates, said outer guiding plates having recesses for said tie rods to provide contact seats, said outer guiding plates having annular gaps for said uncoiled tubes said annular gaps being a size greater than a cross-sectional dimension of said uncoiled tubes to provide boring tolerances.

4. A tubular heat exchanger according to claim 2, wherein said guiding plates include a first and second inner guiding plate, positioned at each side of said coil tube section, said inner guiding plates include recesses forming contact seats for said tie rods, said inner guiding plates including annular gaps for receiving said uncoiled tubes, said annular gaps being dimensioned larger than a cross-sectional dimension of said uncoiled tubes such that a change in direction of gas flow is adjusted along the longitudinal axis of the heat exchanger.

5. A tubular heat exchanger for operation at high gas temperatures and high gas pressures, comprising: a gas inlet side tube bottom and a gas outlet side tube bottom; heat exchanger tubes extending between said gas inlet tube bottom and said gas outlet tube bottom, said heat exchanger tubes being arranged in graduated circles defined by openings in said gas inlet tube bottom and said gas outlet tube bottom, receiving said heat exchanger tubes in said tube bottoms, said heat exchanger tubes including a linear extension with a coiled section and an uncoiled section, said coiled section being greater than said uncoiled section; tie rods for bracing bottoms of said heat exchanger tubes, said tie rods being arranged on each graduated circle extending between said gas inlet to bottom and said outlet to bottom rings provided in said coiled section, connecting said tie rods at several ring connection points, said tie rods having a flattened cross-sectional area at said ring connection points and otherwise having a substantially circular cross-sectional area, every other pair of adjacent said heat exchanger tubes being connected to one another by angular plates in said ring connection area.

* * * * *

UNITED STATES PATENT AND TRADEMARK OFFICE

CERTIFICATE OF CORRECTION

PATENT NO. : 5,186,247

DATED : February 16, 1993

INVENTOR(S) : Alfred Schlemenat

It is certified that error appears in the above-identified patent and that said Letters Patent is hereby corrected as shown below:

On the title page,

Item should read:

[21] Appl. No.: 878,333

Signed and Sealed this

Twenty-third Day of November, 1993

*Attest:*

Bruce Lehman

BRUCE LEHMAN

*Attesting Officer*

*Commissioner of Patents and Trademarks*